US012116718B2

(12) United States Patent
Kessler et al.

(10) Patent No.: US 12,116,718 B2
(45) Date of Patent: Oct. 15, 2024

(54) METHOD AND DEVICE FOR AN AIR-GUIDING DOMESTIC APPLIANCE

(71) Applicant: Henkel AG & Co. KGaA, Duesseldorf (DE)

(72) Inventors: Arnd Kessler, Monheim am Rhein (DE); Lars Zuechner, Langenfeld (DE); Robert Ruiz Hernandez, Duesseldorf (DE); Slavoljub Barackov, Monheim (DE); Thomas Juckel, Monheim (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 771 days.

(21) Appl. No.: 17/290,726

(22) PCT Filed: Oct. 29, 2019

(86) PCT No.: PCT/EP2019/079462
§ 371 (c)(1),
(2) Date: Apr. 30, 2021

(87) PCT Pub. No.: WO2020/089198
PCT Pub. Date: May 7, 2020

(65) Prior Publication Data

US 2022/0002932 A1 Jan. 6, 2022

(30) Foreign Application Priority Data

Oct. 30, 2018 (DE) ..... 10 2018 218 580.8

(51) Int. Cl.
*D06F 58/38* (2020.01)
*A47L 15/00* (2006.01)
*D06F 103/34* (2020.01)

(52) U.S. Cl.
CPC ..... *D06F 58/38* (2020.02); *A47L 15/0034* (2013.01); *A47L 15/0063* (2013.01);
(Continued)

(58) Field of Classification Search
CPC .... D06F 58/38; D06F 2103/34; A47L 15/063; A47L 15/0034; A47L 2401/19; A47L 2501/26; A47L 2501/30
(Continued)

(56) References Cited

U.S. PATENT DOCUMENTS 5,806,204 A * 9/1998 Hoffman ..... D06F 58/24 34/605
7,526,879 B2 * 5/2009 Bae ..... D06F 58/206 34/239
(Continued)

FOREIGN PATENT DOCUMENTS

DE 102018218580 A1 * 4/2020 ..... A47L 15/0034
KR 20040092112 A * 11/2004
(Continued)

*Primary Examiner* — Stephen M Gravini
(74) *Attorney, Agent, or Firm* — Lorenz & Kopf, LLP

(57) ABSTRACT

Among other things, a procedure is revealed which comprises the following: Detecting one or more pieces of air humidity information indicative of a relative humidity within a treatment room of an air-conducting domestic appliance, wherein the one or more pieces of air humidity information are detected by means of at least one air humidity sensor; and determining drying information indicative of a time of an end of a drying process performed by the air-conducting domestic appliance, wherein the drying information is determined based on the one or more pieces of air humidity information. Also disclosed are a device for executing and/or controlling this process, a system with one or more devices for executing and/or control-
(Continued)

ling this process and a computer program for executing and/or controlling this process by a processor.

20 Claims, 7 Drawing Sheets

(52) U.S. Cl.
CPC ..... *A47L 2401/19* (2013.01); *A47L 2501/26* (2013.01); *A47L 2501/30* (2013.01); *D06F 2103/34* (2020.02)

(58) Field of Classification Search
USPC ..... 34/282, 595–610
See application file for complete search history.

(56) References Cited

U.S. PATENT DOCUMENTS 7,921,578 B2 * 4/2011 McAllister ..... D06F 35/00 34/597
8,627,581 B2 * 1/2014 Brown ..... D06F 58/20 34/607
8,800,164 B2 * 8/2014 Kim ..... D06F 25/00 137/597
11,624,147 B1 * 4/2023 Roushall ..... B41M 7/0081 34/595
11,686,041 B2 * 6/2023 Del Maschio ..... D06F 34/18 34/595
11,868,881 B2 * 1/2024 Chae ..... G06N 3/08
2004/0177529 A1 * 9/2004 Kim ..... D06F 58/46 34/562
2022/0002932 A1 * 1/2022 Kessler ..... D06F 58/38
2023/0265592 A1 * 8/2023 Carow ..... D06F 58/40 34/443

FOREIGN PATENT DOCUMENTS

WO WO-02090855 A1 * 11/2002 ..... D06F 58/28
WO WO-2018095732 A1 * 5/2018 ..... A47L 15/0034
WO WO-2020089198 A1 * 5/2020 ..... A47L 15/0034

* cited by examiner

METHOD AND DEVICE FOR AN AIR-GUIDING DOMESTIC APPLIANCE

CROSS-REFERENCE TO RELATED APPLICATION

This application is a U.S. National-Stage entry under 35 U.S.C. § 371 based on International Application No. PCT/EP2019/079462, filed Oct. 29, 2019, which was published under PCT Article 21(2) and which claims priority to German Application No. 10 2018 218 580.8, filed Oct. 30, 2018, which are all hereby incorporated in their entirety by reference.

TECHNICAL FIELD

Sample designs relate to a process for an air-carrying domestic appliance and a device for use in a domestic appliance.

BACKGROUND

Due to growing environmental awareness, many consumers want to reduce their so-called ecological footprint and, for example, consume as little water and energy as possible. This is accompanied, for example, by financial savings through reduced electricity and water consumption.

For many consumers, the running time of dishwashers or tumble dryers therefore plays a major role. Long programs are not immensely popular, short programs only if they can provide sufficient cleaning power.

Processes for operating or controlling domestic appliances, such as washing machines or dishwashers, are known from the state of the art. The aim when operating such domestic appliances is typically to achieve a high degree of user-friendliness and at the same time the best possible result (in the case of a dishwasher, the most flawless cleaning result possible). For this purpose, various programs of the domestic appliances can be parameterized, for example, to achieve the best possible cleaning result. Pre-defined runtimes of the programs can ensure a certain degree of user-friendliness than, for example, when the user is informed of the runtime when starting a program run by the domestic appliance. Especially in air-conducting domestic appliances, a completed drying process takes a lot of time. Due to the variable quantity of items to be dried (e.g., laundry or dishes), this drying time can vary greatly.

The disadvantage is that in many situations and scenarios both the user-friendliness and the drying result to be achieved in this way are still in need of improvement in terms of user-friendliness and energy consumption.

Against this background, the task of the present disclosure is to improve the drying result to be achieved with an air-conducting domestic appliance, about an optimization of the time required and/or energy consumption.

BRIEF SUMMARY

Processes, apparatuses, and systems are provided for performing a process are provided herein. In an embodiment, a process performed by one or more devices comprising:

Detection of one or more items of air humidity information indicative of a relative air humidity within a treatment room of an air-conducting domestic appliance, wherein the one or more items of air humidity information are detected by employing at least one air humidity sensor, wherein the one or more items of air humidity information represent a curve progression of the relative air humidity within the treatment room over time.

Determining drying information indicative of a time of an end of a drying process performed by the air-conducting household appliance, wherein the drying information is determined based on the one or more humidity information.

BRIEF DESCRIPTION OF THE DRAWINGS

The present disclosure will hereinafter be described in conjunction with the following drawing figures, wherein like numerals denote like elements, and.

DETAILED DESCRIPTION

Figure 1:
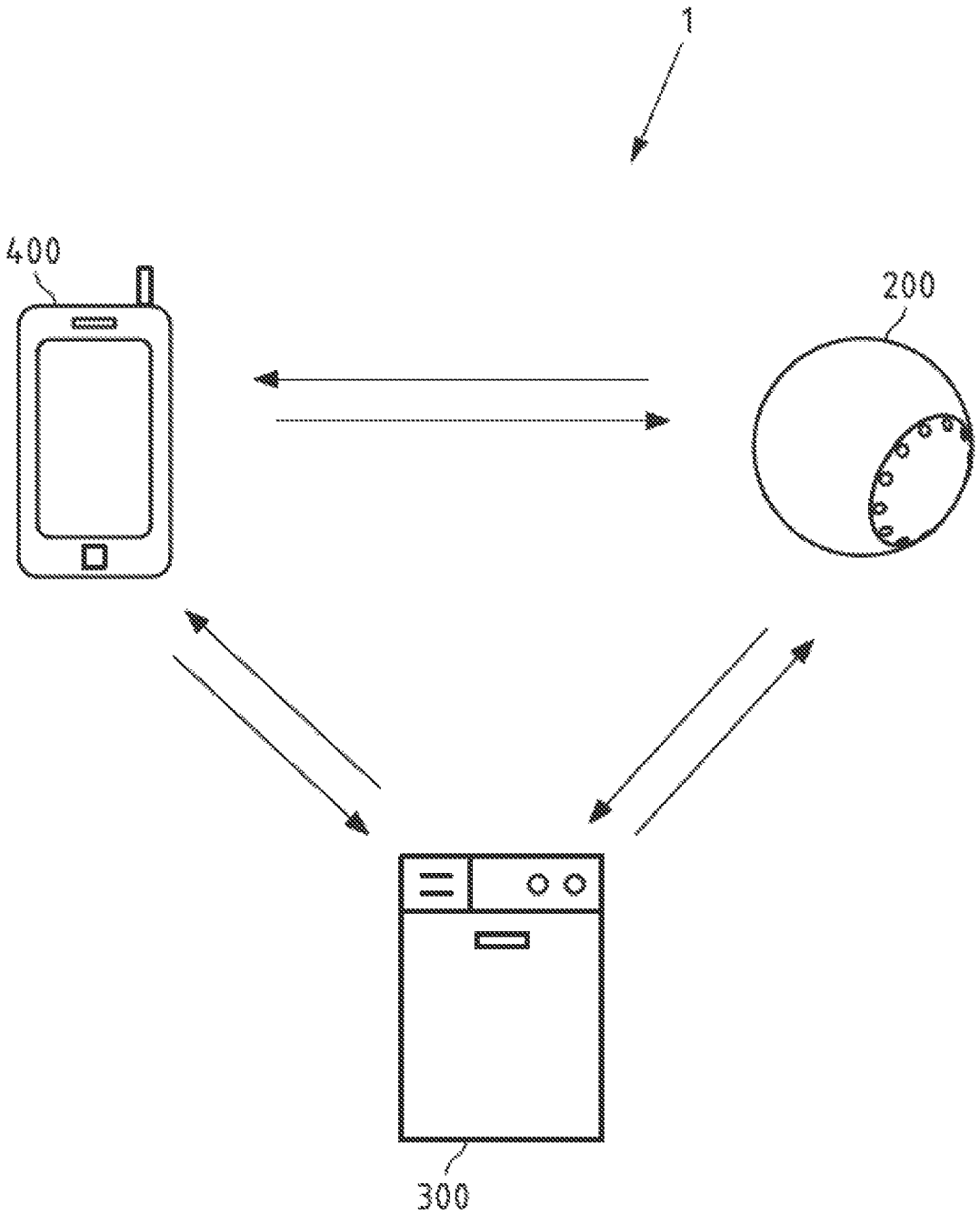
FIG. 1 a schematic representation of an execution example of a system as contemplated herein.

The following detailed description is merely exemplary in nature and is not intended to limit the disclosure or the application and uses of the subject matter as described herein. Furthermore, there is no intention to be bound by any theory presented in the preceding background or the following detailed description.

According to a first exemplary aspect of the invention, a process is disclosed which comprises the following:

Acquisition of one or more air humidity information indicative of a relative air humidity within a treatment room of an air-conducting domestic appliance, whereby the one or more air humidity information is acquired by employing at least one air humidity sensor.

and

Determining drying information indicative of a time of an end of a drying process performed by the air-conducting domestic appliance, wherein the drying information is determined based on the one or more humidity information.

According to one aspect of the invention, one or more pieces of humidity information represent a curve of relative humidity within the treatment room over time t.

According to another aspect of the invention, the process further comprises:

Describing the course of the curve by employing a mathematical function that predicts the humidity inside the treatment room of the air-conducting domestic appliance at any time during the process.

According to a second aspect of the invention, a device is described which is adapted or comprises corresponding features to perform and/or control a process according to the first aspect. Devices of the process according to the first aspect are or comprise one or more devices according to the second aspect.

Alternatively, or additionally, the manner of employing the device according to the second aspect may also include one or more sensors and/or one or more communication interfaces.

By a communication interface for example a wireless communication interface and/or a wire-bound communication interface is to be understood.

A wireless communication interface is for example a communication interface according to a wireless communication technology. An example of a wireless communication technology is a local radio network technology such as Radio Frequency Identification (RFID) and/or Near Field Communication (NFC) and/or Bluetooth (e.g., Bluetooth Version 2.1 and/or 4.0) and/or Wireless Local Area Network (WLAN). For example, RFID and NFC are specified according to ISO standards 18000, 11784/11785 and ISO/IEC standards 14443-A and 15693. WLAN, for example, is specified in the standards of the IEEE 802.11 family Another example of a wireless communication technology is a supra-local radio network technology such as a mobile radio technology, for example Global System for Mobile Communications (GSM) and/or Universal Mobile Telecommunications System (UMTS) and/or Long-Term Evolution (LTE). The GSM, UMTS and LTE specifications are maintained and developed by the 3rd Generation Partnership Project (3GPP).

A wired communication interface is for example a communication interface according to a wired communication technology. Examples of a wired communication technology are a Local Area Network (LAN) and/or a bus system, for example a Controller Area Network bus (CAN bus) and/or a universal serial bus (USB). For example, CAN bus is specified according to the ISO standard ISO 11898. LAN is for example specified in the standards of the IEEE 802.3 family. It is understood that after the second aspect, the device may include other features not listed.

According to the second aspect of the invention, an alternative device is also described, comprising at least one processor and at least one memory containing computer program code, wherein the at least one memory and the computer program code are adapted to execute and/or control with the at least one processor at least one method according to the first aspect. A processor is understood to be, for example, a control unit, a microprocessor, a microcontroller, a digital signal processor (DSP), an application specific integrated circuit (ASIC) or a field programmable gate array (FPGA).

For example, an example device further includes features for storing information such as a program memory and/or a working memory. For example, an exemplary inventive device further includes features for receiving and/or transmitting information over a network such as a network interface. For example, exemplary inventive devices are interconnected and/or connectable via one or more networks.

An exemplary device according to the second aspect is or comprises, for example, a data processing system which is set up in terms of software and/or hardware to be able to carry out the respective steps of an exemplary procedure according to the second aspect. Examples of a computing device are a computer, desktop computer, server, thin client and/or portable computer (mobile device), such as a laptop computer, tablet computer, wearable, personal digital assistant, or smartphone.

Individual process steps of the method according to the first aspect can be carried out with a sensor device, which for example also has at least one sensor element or sensor(s). Likewise, individual process steps, which, for example, do not necessarily have to be carried out with the sensor device, can be carried out by a further device, which is connected in particular via a communication connection with the device, which has at least one sensor element or sensor(s).

According to a design of the process according to the first aspect, the at least one device carrying out the process comprises the air-carrying domestic appliance and/or a device separate therefrom, a mobile device, which can preferably be introduced into the treatment room of the domestic appliance.

For example, the device performing the process is or comprises the domestic appliance, i.e., a dishwasher and/or a tumble dryer or washer-dryer. If the domestic appliance itself is designed for this purpose, the process can be carried out with a small number of devices and without an additional separate device by a user.

Alternatively, however, an additional and separate device to the domestic appliance is provided. This has the advantage that the process can usually be carried out independently of the type and properties of the domestic appliance, which might otherwise not be possible or not to the same extent. The separate device is for example a mobile (portable) device. For example, the separate device is a mobile device that can optionally be in communication with the domestic device (for example, via a wireless network).

However, the separate device can also be a mobile device, which (during operation) can be brought into the domestic appliance, i.e., in the example of a dishwasher and/or a laundry dryer or washer-dryer can be brought into the interior and/or treatment room. Such a separate device is, for example, a dosing device that is designed, for example, to deliver a substance (especially a cleaning agent) to the treatment room. Such a separate device may be in communication with the home appliance, a user's mobile device and/or a remote server (for example, to exchange captured information (e.g., air humidity information, ambient humidity information, to name a few non-limiting examples).

A housing surrounding the device is, for example, designed to be positioned in the treatment room of the domestic appliance and has an appropriate size which allows the housing or device to be at least partially removed from the treatment room. In particular, the housing or device can be positioned loosely and/or without connecting features in the treatment room. For example, in the case of the dishwasher and/or the clothes dryer or washer-dryer, the housing or device shall be brought into and/or removed from the treatment room together with the objects to be cleaned and/or dried (e.g., laundry or dishes). The housing of the device encloses individual, or all features of the device partially or completely. In particular, the housing is designed to be watertight so that some or all the features of the device do not meet water when the device is positioned in a treatment room, for example the treatment room of the dishwasher and/or the laundry dryer or washer-dryer and during a treatment.

The device or housing referred to in the second aspect is a mobile and/or portable device and/or a device distinct from the domestic appliance. A mobile and/or portable device shall mean, for example, a device whose external dimensions are smaller than 30 cm×30 cm×30 cm, preferably smaller than 15 cm×15 cm×15 cm. A device other than a domestic appliance is, for example, a device which has no functional connection with the domestic appliance and/or is not a part permanently connected to the domestic appliance. For example, a mobile and/or portable device as well as a device that is different from the domestic appliance shall be understood as a device that is brought (e.g., inserted) into the treatment room of the domestic appliance by a user for the duration of a treatment process (e.g., cleaning program). An example of such a mobile and/or portable device, which is different from the domestic appliance, is a dosing device and/or a sensor device that is placed in the treatment room before starting a treatment.

The housing can have at least one dispensing module, which is designed to dispense at least one preparation into the treatment room of the domestic appliance and/or to trigger a dispensing. The dispensing of a preparation, for example comprising cleaning agents, is to be understood, for example, to mean that the preparation is dispensed to the environment of the dispensing module and/or a storage container for the preparation. The output is done for example by the output module. Alternatively, or additionally the output can be affected by the output module, e.g., the output module causes the preparation to be output through the supply container. For example, the preparation is dispensed through a dispensing opening of the dispensing module and/or the storage container to the environment of the dispensing module and/or the storage container.

Further devices can be provided, for example a server and/or, for example, a part or component of a so-called computer cloud, which dynamically provides data processing resources for different users in a communication system. A computer cloud is understood to be a data processing infrastructure as defined by the National Institute for Standards and Technology (NIST) for the English term "Cloud computing". One example of a computer cloud is the Microsoft Windows Azure Platform.

According to the second aspect of the invention, a computer program is also described which comprises program instructions which cause a processor to execute and/or control a process according to the first aspect when the computer program runs on the processor. An exemplary program as contemplated herein may be stored in or on a computer-readable storage medium containing one or more programs.

According to the second aspect of the invention, a computer-readable storage medium is also described which contains a computer program according to the second aspect. A computer-readable storage medium can, for example, be a magnetic, electrical, electro-magnetic, optical and/or other storage medium. Such a computer-readable storage medium is preferably representational (i.e., "touchable"), for example it is designed as a data carrier device. Such a data carrier device is for example portable or permanently installed in a device. Examples of such storage devices include volatile or non-volatile random-access memory (RAM) such as NOR flash memory or sequential access memory such as NAND flash memory and/or read-only memory (ROM) or read-write memory. Computer-readable, for example, should be understood to mean that the storage medium can be read and/or written to by a computer or a data processing system, for example by a processor.

According to a third aspect of the invention, a system is also described comprising one or more devices which together perform a process according to the first aspect.

In the following, exemplary features and exemplary designs are described in more detail according to all aspects:

The present disclosure is based on the knowledge that humidity parameters (e.g., air humidity) in the air space of a corresponding air-conducting domestic appliance can be measured, evaluated and optionally, e.g., with the aid of algorithms, proposals for action can be submitted to a user of the domestic appliance.

The solution as contemplated herein makes it possible for the first time to follow a drying process in an air-conducting domestic appliance (e.g., clothes dryer, washer-dryer, dishwasher, to name but a few non-limiting examples) and to give the user an indication at the best possible time that, for example, his laundry and/or items to be dried in the dishwasher are completely dried. The notification is now linked to a measured value, not to the expiration of a time window as before. This results in at least one time saving (e.g., in the case of the dishwasher) or a time and energy saving (e.g., in the case of the tumble dryer and/or washer-dryer) for the user. The user then completes the drying process manually, for example, before the actual end scheduled by the domestic appliance manufacturer.

Furthermore, according to the first aspect of the present invention, the process can describe, for example, the drying process. This can be used to the advantage of the user, for example, as it is already possible to predict during a running drying process when the drying process will be finished. The user is thus able to better plan and optimize his budget transactions.

The recorded one or more air humidity information (e.g. measured values from the at least one air humidity sensor and/or optionally from at least one air pressure sensor) can also be used, e.g. in conjunction with an API (Application Programming Interface), to actively control the drying process in the domestic appliance and/or to terminate processes of the domestic appliance (e.g. an executed drying or cleaning program comprising a drying process), e.g. in a measurement value-controlled manner. This is advantageous for the user, because he does not have the feeling that he terminates a process prematurely, which is sometimes unfavorable in his opinion (e.g., because the drying process might not yet be finished) and/or there might be a malfunction due to the premature termination. In the case of a domestic appliance designed as a dishwasher, for example, this type of control and/or regulation can be especially useful, as condensate sometimes still must be pumped out at the end of a drying process. For example, a simple abort of the executed program from the dishwasher would not execute this operation anymore.

The domestic appliance is, for example, a clothes dryer, washer-dryer, or a dishwasher, to name but a few non-limiting examples. Accordingly, a design based on all aspects of the present disclosure provides that the air-conducting domestic appliance is a clothes dryer, washer-dryer, or dishwasher.

A tumble dryer usually carries out a drying process of already cleaned objects (e.g., laundry, such as textiles), which are brought into the treatment room of the tumble dryer after their cleaning. The items brought into the treatment room of the tumble dryer are dried by a drying process.

A washer-dryer usually uses a cleaning agent (e.g., so-called detergent and/or fabric softener, to name but a few non-limiting examples) to clean and/or care for items brought into the treatment room (e.g., laundry, such as textiles). After the cleaning has been carried out, these objects already placed in the treatment room are dried by a drying process.

A dishwasher usually uses a detergent (e.g., so-called dishwasher tabs and/or rinse aid) to clean items brought into the treatment room, such as cutlery, crockery, pans, or pots, to name but a few non-limiting examples. After the cleaning has been carried out, these objects already placed in the treatment room are dried by a drying process.

The one or more air humidity information is indicative of a relative humidity within the treatment room of the air-conducting domestic appliance, e.g., a dishwasher or a tumble dryer or washer-dryer.

Air humidity—or humidity for short—describes the proportion of water vapor in the gas mixture of the air. Depending on temperature and pressure, a given volume of air can only contain a certain maximum amount of water vapor. The relative humidity is then 100%. For the purposes of the invention, relative humidity, expressed for example in percent (%), indicates the weight ratio of the instantaneous water vapor content to the water vapor content which is maximum possible for the current temperature and pressure with respect to the air present in the treatment room of the domestic appliance.

The one or more air humidity information is acquired, for example, by the at least one air humidity sensor determining the one or more air humidity information, e.g., measuring one or more measured values.

The at least one humidity sensor is a humidity sensor (e.g., a hygrometer). Optionally, at least one air pressure sensor may also be provided so that the one or more air humidity information can further represent measured values acquired by the at least one air pressure sensor. Such an air pressure sensor is for example an absolute, differential and/or relative pressure sensor.

For example, a moisture sensor detects (e.g., measures) an electrical signal, e.g., based on the changing electrical properties of certain materials with varying water absorption. Examples of such humidity sensors include impedance sensors, which detect, for example, the electrical conductivity that changes. Furthermore, such a humidity sensor can be e.g., a capacitive sensor which detects (e.g., measures) the changing capacity of a dielectric enclosed by the sensor.

In an exemplary design of the invention, the procedure further comprises:

Collect or obtain ambient humidity information indicative of a humidity level that exists or is expected to exist in the ambient air of the domestic appliance.

where the drying information is further determined based on the ambient moisture information.

The ambient humidity information is indicative of a humidity value that exists or should exist in the ambient air of the domestic appliance. This is for example the relative humidity outside the treatment room or outside the domestic appliance itself. As a rule, a relative humidity of about 40% to about 50% is perceived as pleasant. Accordingly, the ambient humidity information can also be predefined to a relative humidity of about 40% to about 50%. Alternatively, the ambient humidity information can also be predefined using an ambient humidity threshold value. This threshold value can be changed, for example. For example, the threshold value represents a relative humidity of about 40% to about 50%, or less than 40% or more than 50%, to name but a few non-limiting examples. In this case, for example, no air humidity sensor is needed to record the ambient humidity information, but a corresponding ambient humidity information can be obtained. Further details are explained in the following paragraph.

The ambient humidity information is acquired, for example, by collecting the ambient humidity information from an air humidity sensor located outside the treatment room or outside the domestic appliance. Alternatively, the ambient humidity information can be obtained e.g. from the apparatus according to the second aspect of the present invention, which executes and/or controls the process according to the first aspect of the invention, by e.g. the ambient humidity information is acquired by a further device comprising an air humidity sensor arranged outside the treatment room or outside the domestic appliance and subsequently transmitted to the device according to the second aspect of the present invention, which executes and/or controls the process according to the first aspect of the invention, e.g. via a wireless or wired communication link between these two devices. Alternatively, the ambient humidity information can be collected from an external source, e.g., provided by a weather service, by determining the ambient humidity information from information provided by the external source (e.g., by accessing the external source via an API (Application Programming Interface), and/or by employing a so-called push notification, just to name a few non-limiting examples). For example, the communication interface can be used for this purpose, so that the external source can be accessed via a communication network (e.g., the Internet). Alternatively, or additionally, ambient humidity information may include or represent air pressure information indicative of air pressure or relative air pressure at a predetermined location. It goes without saying that, alternatively, both ambient humidity information and air pressure information can be recorded separately as described above. Capturing the ambient humidity information, for example from an external source, offers the advantage, among other things, that the process can be carried out more cost-effectively, since, for example, no sensor needs to be included in the device that carries out and/or controls the process according to the first aspect.

The drying information indicative of the time of the end of the drying process performed by the air-carrying domestic appliance is determined, for example, by evaluating the air humidity information or the air humidity information and the ambient humidity information.

The determination of the drying information, for example, is performed while the acquisition of the one or more humidity information continues. This means, for example, that for a pre-defined period, e.g., one minute to name only one non-limiting example, measured values are recorded by employing at least one humidity sensor, and then a first drying information is determined. During the determination of this drying information further one or more humidity information is recorded. At least partly based on this or these further humidity information, a further (second) drying information is then determined. This sequence can be repeated, for example, until the end of the drying process is reached. In this way, the end of the drying process can be approached iteratively. For example, the described repeated execution can be stopped if the end of the drying process is predicted with sufficient accuracy.

A design based on all aspects of the present disclosure provides that the time of the end of the drying process carried out by the air-conducting domestic appliance considers a period for pumping off condensate, and the drying information is determined accordingly. This applies if the domestic appliance is designed as a dishwasher and the condensate should be completely pumped out before removing completely dried objects (e.g., dishes).

A design according to all aspects of the present disclosure provides that the drying information is further indicative of a humidity value of one or more objects within the treatment room, whereby the one or more objects are subject to drying by employing the drying process.

The one or more recorded air humidity information can, for example, also be evaluated in such a way that a humidity value of one or more objects within the treatment room, which are subject to drying by employing the drying process, is determined. This enables an even more precise and faster termination of the drying process if the objects to be dried have, for example, a relative humidity that corresponds to the relative humidity represented according to the ambient humidity information that prevails or should prevail in the ambient air of the domestic appliance, i.e. outside the treatment room or outside the domestic appliance itself (e.g. because the relative humidity represented according to the ambient humidity information is perceived as pleasant by the user of the domestic appliance).

A design according to all aspects of the present disclosure provides that the one or more pieces of air humidity information represent a curve progression of the relative air humidity within the treatment room over time, wherein the curve progression is described by employing an n-graded polynomial function, in particular a polynomial function of third or fourth degree, and wherein the determination of the drying information is further based on the polynomial function.

Advantageously, the description of the temporal development of the humidity information can also be implemented with other mathematical functions. This makes it possible to predict the future humidity in the domestic appliance and/or on the textiles as well as the time it will be reached. The end of a drying process can be set for a time when the specified humidity falls below a specified threshold value.

The course or curve progression of one or more recorded (e.g., measured) air humidity information is represented, for example, by many measured relative humidity values recorded over a predetermined period, whereby the respective recorded (e.g., measured) relative humidity values are mapped to represent the course over a time axis.

The one or more humidity information is evaluated, for example, by analyzing the curve progression of the relative humidity values that are included or represented by the one or more humidity information. Since the one or more air humidity information can be described by the polynomial function, highly accurate predictions can be made if the relative humidity within the treatment room corresponds, for example, to that represented by the ambient humidity information. In this way, for example, a current relative humidity within the treatment room can be inferred to a relative target humidity within the treatment room, which is represented by the ambient humidity information, for example. The result can then be included or represented by the drying information. Accordingly, the polynomial function can be used to predict the end of the drying process by using the polynomial function and determining (e.g., analyzing) when the relative humidity of the treatment room corresponds to that of the ambient air from the domestic appliance.

A design based on all aspects of the present disclosure provides that a polynomial function is determined based on the curve of the relative humidity within the treatment room over time.

Since the measured relative humidity values represented or encompassed by the one or more humidity information may sometimes be subject to (strong) fluctuations, it may be advisable, for example, to perform a communication of these measured values, especially to neutralize fluctuations in amplitude within a short period of time (e.g., 1 to 5 seconds) of the one or more humidity information. The drying information is further determined, for example, by considering this message of one or more air humidity information.

A configuration according to all aspects of the present disclosure provides that at least two relative air humidity values are represented or comprised by the one or more air humidity information, wherein the at least two relative air humidity values are further each linked to a detection time so that the polynomial function maps the at least two relative air humidity values over their respective detection times.

For example, the relative humidity in the treatment room can be recorded at different times. The relative humidity measured in each case can, for example, be mapped to the points in time also recorded, so that a polynomial function mapping these values can be determined from the points in time (e.g., x values) and the relative humidity values measured in each case (e.g., y values). Using this polynomial function, the temporal end of the drying process can then be predicted by using an intended relative humidity at the temporal end of the drying process as the input value of the polynomial function. It goes without saying that there are also other ways of using such a polynomial function, especially to predict the end of the drying process.

In a design according to all aspects of the invention, the procedure further comprises:

Output or initiation of the output of the specific drying information.

After the drying information has been determined, for example, an output or initiation of the output of the determined drying information follows. This can be done once, for example.

A design according to all aspects of the present disclosure provides that the output or initiation of the output of specific drying information is repeated so that a user of the air-conducting domestic appliance is informed of the current status of a program or drying process performed by the domestic appliance.

The continuous acquisition of one or more pieces of humidity information and the subsequent determination of the drying information (at least based on the one or more pieces of humidity information that have been added and have not yet been considered when determining the drying information) can result in the output or the initiation of the output of the drying information being performed several times. For example, the output can be made to the domestic appliance in the case that the procedure according to the first aspect of the present disclosure is carried out by a device separate from the domestic appliance. Alternatively, or additionally, the output or the initiation of the output can be made, for example, to a device that is different from the domestic appliance or from the separate device, such as a server. For example, the server can provide so-called cloud services. For example, such a server can determine a control information for controlling and/or regulating the domestic appliance or device according to the second aspect of the invention, just to name a few non-limiting examples.

Drying information is output, for example, by push message. Drying information can also be output to the user's mobile device, for example, so that the user is informed about the predicted end of the drying process performed by the domestic appliance.

In a design based on all aspects of the invention, the output, or the initiation of the output of the specific drying information takes place at the best possible (e.g., first possible) time, e.g., to a mobile device of the user. For example, this best possible time is the point in time when there is a high probability (e.g., greater than 90% or 95% or 99%) that the exact end (e.g., to the nearest minute, or less, to name a few non-limiting examples) is predicted and the corresponding result is represented by the specific drying information.

In a design according to all aspects of the invention, the procedure further comprises:

Control and/or regulation of the air-carrying domestic appliance at least partially based on the specific drying information.

Based on the drying information, for example, a control information can be determined which enables the control and/or regulation of the air-carrying domestic appliance. For example, the domestic appliance can be a self-contained domestic appliance. The domestic appliance may also include, for example, the device referred to in the second aspect of the invention. Alternatively, or additionally the control and/or regulation of a dosing device described above can at least be based on the specific drying information.

The control and/or regulation can, for example, initiate or effect the operation or control of a domestic appliance at least under consideration of the specific drying information. Such operation or control can, for example, include changing a cleaning program or drying process carried out by the domestic appliance. For example, one or more process parameters of a cleaning program or drying process performed by the domestic appliance can be changed and/or process sections can be added or omitted. Furthermore, a drying process performed by the domestic appliance can be terminated prematurely in this way, for example if the relative humidity inside the treatment room or that of the objects arranged inside the treatment room for drying corresponds to the relative humidity represented by the ambient humidity information.

According to a further design of the procedure according to the first aspect, the control and/or regulation of the air-conducting domestic appliance further influences:

switching on and/or off the air-conducting domestic appliance.

a cleaning program comprising a drying process (if the domestic appliance is a dishwasher or washer-dryer) or a drying process (if the domestic appliance is a clothes dryer) of the domestic appliance.

About switching the domestic appliance on and/or off, it can be influenced, for example, whether the domestic appliance is switched on and/or off (at all) and/or at what time (time, date) the domestic appliance is switched on and/or off, just to name a few non-limiting examples. For example, the domestic appliance cannot be switched on if the relative humidity represented by the ambient humidity information outside the treatment room or outside the domestic appliance differs significantly from a relative humidity that the user may find comfortable (e.g., about 40% to about 50% relative humidity).

Influencing the cleaning program comprehensively a drying process or influencing the drying process of the domestic appliance can, for example, include prematurely terminating a certain (pre-programmed) program, influencing (e.g., shortening) the program runtime, or changing individual parameters of the program (e.g., the temperature, to name just one non-limiting example).

In addition, it is possible not only to operate or control the operation of the domestic appliance (automatically) based on the drying information, but also to give the user a recommendation. For example, it may be possible that in addition to an automated adjustment of the home appliance, a recommendation may also be displayed to the user, for example, via an output device of a user interface (e.g., included in the home appliance or via the user's mobile device). For example, the user can be informed that e.g., by a corresponding temperature increase of the drying process to be performed or carried out in the treatment room of the domestic appliance, the drying time can be or will be shortened.

A design according to all aspects of the present disclosure provides that the control and/or regulation of the air-carrying domestic appliance causes a drying process performed by the air-carrying domestic appliance to be terminated as soon as the objects to be dried within the treatment room have the relative humidity value represented by the ambient humidity information.

Thus, as already explained, a cleaning program performed by the domestic appliance can comprehensively terminate the drying process or the drying process performed by the domestic appliance before the relative humidity intended or desired by a manufacturer of the domestic appliance, which is sometimes far below the relative humidity represented by the ambient humidity information, is reached. This can significantly reduce the energy consumption of the domestic appliance and significantly shorten the drying time or runtime of a cleaning program performed by the domestic appliance.

A configuration according to all aspects of the present disclosure provides that the drying information is further determined based on historical humidity information and/or historical specific drying information of one or more drying processes previously performed with the air-conducting domestic appliance.

Such historical humidity information and/or historical drying information may include or represent, for example, what time(s) of an end of a drying process performed by the air-conducting domestic appliance was determined in the past. Z. E.g., which relative humidity values at a certain time of an end of a drying process carried out by the domestic appliance. The drying information can, for example, also be determined based on this one or more historical humidity information and/or one or more historical drying information. For example, it is possible to compare whether the specific drying information deviates significantly from one or more historical drying information (e.g., by comparing it with a predefined threshold value (e.g., 5%, 10%, 15%, 20%, or more deviation of the time of the end from the drying process), so that such a deviation can be indicative of a faulty at least one humidity sensor, for example. In this case, the drying information can also represent, for example, that there may be an error and/or defect in at least one humidity sensor. The user can then be informed about the error and/or defect, for example, by outputting or causing the output of the specific drying information.

A design according to all aspects of the present disclosure provides that at least the steps of acquiring the one or more humidity information and determining the drying information are performed repeatedly.

The steps of acquiring one or more humidity information and determining the drying information can, for example, take place continuously over time intervals that are either predefined or pre-defined according to predefined rules. The steps of detecting the one or more air humidity information and determining the drying information can e.g., B. each carried out sequentially. Thus, for example, one or more humidity information can be recorded first. The drying information is then determined. Then again, the one or more humidity information can be recorded again, but not simultaneously with the determination of the drying information. Alternatively, the re-acquisition of the one or more humidity information is done only after a time interval has elapsed, e.g., 5, 10, 30, 45, or 60 seconds, or 2, 3, 4, 5, or more minutes.

A configuration according to all aspects of the present disclosure provides that the at least one air humidity sensor (and optionally the at least one air pressure sensor) is (are) arranged fixed or freely movable within the treatment room in the moist air flow from the air-conducting domestic appliance.

The arrangement of the at least one humidity sensor within the humid air flow from the air-conducting domestic appliance enables the at least one humidity sensor to acquire one or more pieces of humidity information representing sufficiently accurate readings of the relative humidity prevailing within the treatment room from the domestic appliance.

Optionally, a temperature sensor can also acquire (e.g., measure) one or more temperature information simultaneously with the one or more humidity information in the treatment room of the domestic appliance. The drying information can also be determined based on the one or more temperature information. For example, the one or more temperature information can be used to verify the time of the end of the drying process represented by the drying information.

An arrangement according to all aspects of the present disclosure provides that the device according to the second aspect is designed to communicate with the domestic appliance, to communicate wirelessly with the domestic appliance.

For example, by employing a communication interface covered by the device according to the second aspect of the invention, communication with the domestic appliance can be established. The communication interface is especially designed to communicate wirelessly with the domestic appliance.

In a further exemplary design based on all aspects of the invention, the drying information is determined by employing an artificial neural network.

For example, the one or more humidity information and optionally the ambient humidity information can be communicated (e.g., transmitted) to a server that comprises or is connected to an artificial neural network. The determination of the drying information can then be carried out using the artificial neural network, for example. Then, for example, the result can be communicated to the device according to the second aspect of the present disclosure and/or to the domestic appliance.

The artificial neural network includes, for example, an evaluation algorithm, so that, for example, training cases can be learned from as examples and these can be generalized as a basis for determining a result (the drying information) after completion of the learning phase. This means that examples are not simply learned by heart, but patterns and regularities in the learning data are recognized. Different approaches can be followed for this purpose. For example, supervised learning, semi-monitored learning, unsupervised learning, reinforced learning and/or active learning can be used. Supervised learning can, for example, take place using an artificial neural network (such as a recurrent neural network) or a support vector machine. Unsupervised learning can also take place by employing an artificial neural network (e.g., an autoencoder). As learning data serve then for example in particular several times seized air humidity information and optional environment humidity information and/or the drying information determined after a run the artificial neural net.

It is also possible to use the repeated acquisition of one or more humidity information and the optional ambient humidity information or drying information for machine learning. For example, a user profile or one or more pieces of information included in the user profile can be determined at least partially based on machine learning.

By these measures the reliability of determining an exact time of the end of the drying process performed by the domestic appliance and/or a control and/or regulation of the domestic appliance and/or apparatus according to the second aspect of the present disclosure can be increased.

Each of the training cases can be given, for example, by an input vector, at least an air humidity information and optionally an environmental humidity information and an output vector of the artificial neural network.

Each training case of the training cases can be generated, for example, by controlling and/or regulating the device associated with the training case according to the second aspect of the present disclosure and/or the domestic appliance, as well as determining the corresponding drying information into a predetermined state (e.g. defined quantity, type and position of objects within the treatment room of the domestic appliance and defined drying process), and representative of an air humidity information characteristic of the respective state (in particular relative humidity) of the treatment room and optionally an environment information is recorded or obtained, and simultaneously an e g manual analysis of the state (in particular relative humidity) of the treatment room of the domestic appliance is carried out. The then acquired air humidity information and optionally the one ambient humidity information are determined for example as input vector, and the (actual) condition of the treatment room of the domestic appliance is determined as output vector of the training case e.g., as reference drying information. Then the drying information determined by the artificial neural network is transferred to that of the output vector. In this way the artificial neural network can be taught iteratively or successively and the accuracy (e.g., hit rate) of the artificial neural network can be increased.

The exemplary embodiments of the present disclosure previously described in this description should also be understood as disclosed in all combinations with each other. Exemplary designs should be understood in terms of the different aspects revealed.

In particular, the previous or following description of process steps according to preferred forms of execution of a process shall also reveal corresponding features for carrying out the process steps by preferred forms of execution of a device. Likewise, the disclosure of features of a device for carrying out a process step should also reveal the corresponding process step.

Further advantageous exemplary embodiments of the present disclosure can be found in the following detailed description of some exemplary embodiments of the present invention, especially in connection with the figures. However, the figures should only serve the purpose of clarification, but not to determine the scope of protection of the invention. The figures are not to scale and are merely intended to reflect the general concept of the present disclosure by way of example. Features contained in the figures should in no way be regarded as a necessary component of the present invention.

Detailed Description of Some Exemplary Embodiments of the Invention

FIG. 1 first shows a schematic representation of an execution example of a System 1 as contemplated herein comprising the following entities: a device 200, a domestic appliance 300 and a mobile device 400. System 1 is set up to perform exemplary procedures as contemplated herein. The device 200 is an exemplary mobile device 200 (e.g., a dosing device), which in this case can be placed in the treatment room of the domestic appliance 300. Both the device 200 and the domestic appliance 300 may each be a device as contemplated herein. System 1 also includes the mobile device 400 in the form of a smartphone as a further device. The mobile device 400 can also perform individual steps of exemplary procedures as contemplated herein. However, the Mobile Device 400 can also be a computer, a desktop computer, or a portable computer, such as a laptop computer, a tablet computer, a personal digital assistant (PDA) or a wearable. In addition, or as an alternative to the domestic device 300 and the mobile device 400, the system can also include a server (not shown). It is also conceivable that System 1 also includes fewer or more than three fixtures.

Each of the entities can have a communication interface to communicate or exchange information with one or more of the other devices.

Figure 3:
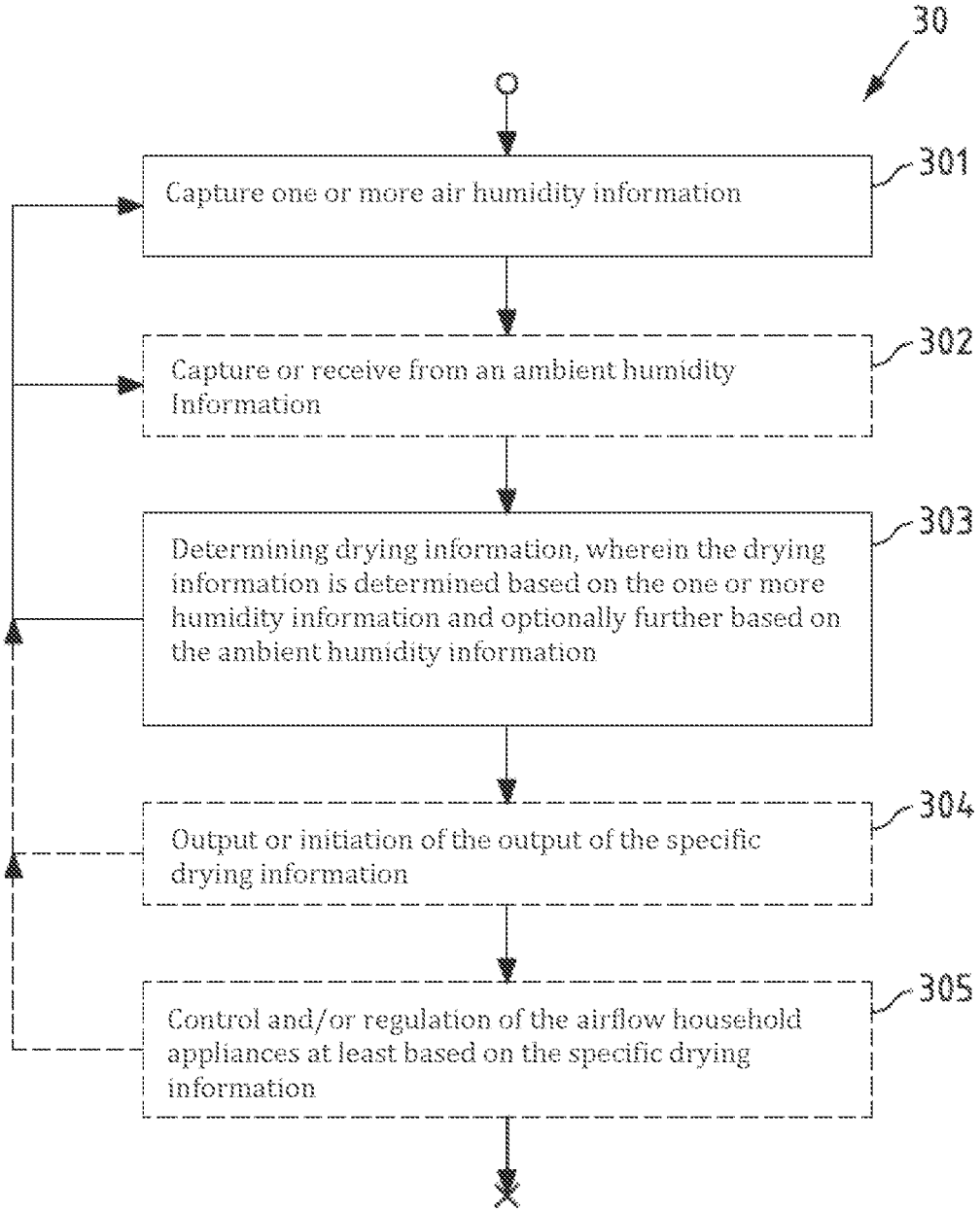
FIG. 3 a flow chart of an execution example of a process as contemplated herein.

FIG. 3 shows a flowchart 30 of an execution example of a process according to the first aspect of the invention. For example, flow chart 30 can be executed by the device 200 according to FIG. 1. The flow chart 30 can be executed, for example, by the domestic appliance 300 according to FIG. 1. For example, flow chart 30 can be executed by both the device 200 according to FIG. 1 and the domestic appliance 300 according to FIG. 1 together. For example, flowchart 30 can be executed by the entities shown in FIG. 1 together.

In a first step 301, one or more pieces of humidity information indicative of a relative humidity within a treatment room of an air-conducting domestic appliance are recorded. The one or more air humidity information is collected for example by employing at least one air humidity sensor. Step 301 is performed, for example, by the device 200 according to FIG. 1. In this case, the device 200 according to FIG. 1 includes at least one air humidity sensor (e.g., air humidity sensor 215 according to FIG. 2). Step 301 can be performed alternatively or additionally by the domestic appliance 300 according to FIG. 1. In this case, the domestic appliance 300 according to FIG. 1 includes at least one humidity sensor (e.g., humidity sensor 215 according to FIG. 2).

In an optional second step 302, ambient humidity information indicative of a humidity value that exists or is expected to exist in the ambient air (e.g., the ambient air of the domestic appliance 300 according to FIG. 1) of the domestic appliance 300 (e.g., the entity according to FIG. 1) is collected or obtained. Step 302 is performed, for example, by the device 200 according to FIG. 1. In this case, the device 200 according to FIG. 1 can be operatively (e.g., electrically, via a wireless communication connection) connected to a further air humidity sensor (e.g., air humidity sensor 215 according to FIG. 2), whereby this further air humidity sensor is located outside a treatment room of the domestic appliance 300 according to FIG. 1. Step 302 can be performed alternatively or additionally by the domestic appliance 300 according to FIG. 1. In this case, the domestic appliance 300 according to FIG. 1 includes at least one additional humidity sensor (e.g., humidity sensor 215 according to FIG. 2), which is located outside the treatment room of the domestic appliance 300 according to FIG. 1.

In a third step 303, a drying information indicative of a time of an end of a drying process performed by the air-conducting domestic appliance is determined. The drying information is determined based on the one or more humidity information (step 301) and optionally further based on the ambient humidity information (step 302). For example, step 303 is performed by the device 200 according to FIG. 1, e.g., by the processor 210 according to FIG. 2. Step 303 can be performed alternatively or additionally by the domestic appliance 300 according to FIG. 1. Step 303 can be performed alternatively or additionally by the mobile device 400 according to FIG. 1. In this case, before determining the drying information to the mobile device 400 according to FIG. 1, the one or more detected humidity information (step 301) and the detected or obtained ambient humidity information (step 302) are transmitted to the mobile device 400 according to FIG. 1 by the respective device that has performed or controlled the corresponding step 301 and/or 302, e.g. via a wireless communication link between the device 200 according to FIG. 1 and/or the domestic device 300 according to FIG. 1 and the mobile device 400 according to FIG. 1.

In an optional fourth step 304, the specific drying information is output or initiated. For example, the drying information is output to an entity according to FIG. 1. If the drying information is output, for example, to the domestic appliance 300 according to FIG. 1, the domestic appliance 300 can, for example, end a drying process based on the drying information in such a way that the objects to be dried have a relative humidity, e.g., on their surface, which corresponds to that of the ambient air of the domestic appliance 300 according to FIG. 1. For example, if the drying information is output to the mobile device 400 as shown in FIG. 1 (e.g., a user's mobile device), the user of the mobile device 400 can be prompted to perform an action or informed of a predicted end of a drying process performed by the domestic device 300 as shown in FIG. 1.

In an optional fifth step 305, control and/or regulation of the air-carrying domestic appliance is performed at least based on the determined drying information. For example, a tax information can be determined for this purpose, which can then be output again. In case the drying information has been output to the mobile device 400 according to FIG. 1 in step 304, this mobile device 400 can also perform step 305. Subsequently, the specific control information can, for example, be output from the mobile device 400 to the device 200 and/or the domestic device 300 according to FIG. 1, so that the device 200 and/or the domestic device 300 according to FIG. 1 trigger an action corresponding to the control information, e.g., termination of a drying process, to name only one non-limiting example. Alternatively, the drying information determined by the device 200 according to FIG. 1 can be output to the domestic appliance 300 and/or the mobile appliance 400 according to FIG. 1 accordingly.

The step 301 of acquiring the one or more humidity information and/or the step 302 of acquiring or receiving the ambient humidity information can be performed simultaneously, for example. The step 301 of acquiring the one or more humidity information and/or the step 302 of acquiring or maintaining the ambient humidity information can be performed alternatively or additionally sequentially. In this latter case, the acquisition of one or more humidity information (step 301) and the acquisition of the ambient humidity information (step 302) is done at different times, for example. In case step 301 and/or step 302 are executed and/or controlled several times, steps 301 and 302 can also be executed and/or controlled simultaneously but repeatedly at different times. In addition, step 301 and/or step 302 can be performed simultaneously with step 303. This means, for example, that after an initial execution of step 301 and step 302, step 303 of determining the drying information is performed, while step 301 and step 302 continue to be executed by acquiring (a) further humidity information(s) (step 301) and/or (a) further ambient humidity information(s) (step 302). These can then be used to execute and/or control step 303 again. This is shown schematically in FIG. 3 using the arrows referring to steps 301 and 302.

Figure 2:
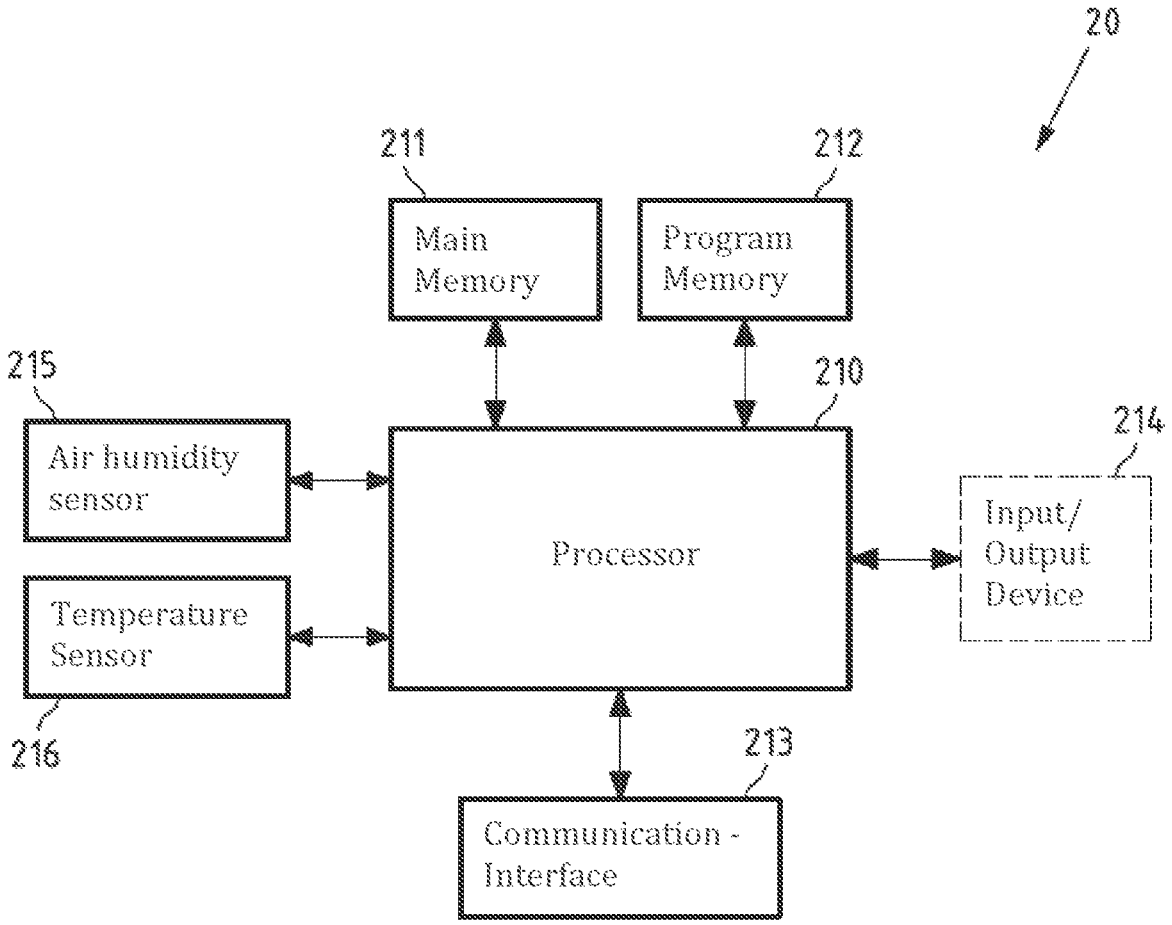
FIG. 2 a block diagram of an execution example of a device as contemplated herein for executing an execution example of a process as contemplated herein.

FIG. 2 now shows a block diagram of an execution example of a device according to the second aspect of the present disclosure for executing an execution example of a process according to the first aspect of the invention. The block diagram in FIG. 2 can be used as an example for the device 200 (a dosing unit), the domestic device 300 or the mobile device 400 (or part of it) shown in FIG. 1.

Processor 210 of device 20 according to FIG. 2 is especially designed as a microprocessor, microcontrol unit, microcontroller, digital signal processor (DSP), application specific integrated circuit (ASIC) or field programmable gate array (FPGA).

Processor 210 executes program instructions stored in program memory 212 and stores, for example, intermediate results or similar in working or main memory 211. For example, Program Memory 212 is a non-volatile memory such as a flash memory, magnetic memory, EEPROM (electrically erasable programmable read-only memory) and/or optical memory. Main memory 211 is for example a volatile or non-volatile memory, in particular a random-access memory (RAM) such as a static RAM memory (SRAM), a dynamic RAM memory (DRAM), a ferroelectric RAM memory (FeRAM) and/or a magnetic RAM memory (MRAM).

Program memory 212 is preferably a local data carrier connected to the device 20 according to FIG. 2. Data carriers connected to the device 20 according to FIG. 2 are for example hard disks, which are installed in the device 20 according to FIG. 2. Alternatively, the data carrier can, for example, also be a data carrier that can be detachably connected with the device 20 according to FIG. 2.

Program memory 212 contains, for example, the operating system of the fixture 20 according to FIG. 2, which is at least partially loaded into main memory 211 when starting the fixture 20 according to FIG. 2 and executed by processor 210. When device 20 is started according to FIG. 2, at least part of the core of the operating system is loaded into main memory 211 and executed by processor 210.

The operating system allows the use of the device 20 according to FIG. 2 for data processing. For example, it manages resources such as main memory 211 and program memory 212, communication interface 213, the optional input and output device 214, provides other programs with basic functions via programming interfaces and controls the execution of programs.

Processor 210 controls besides the communication interface 213, which can be for example a network interface and be developed as network map, network module and/or modem. The communication interface 213 is especially designed to establish a connection of the device 20 according to FIG. 2 with other devices (e.g., at least one of the entities according to FIG. 1), especially via a (wireless) communication system, for example a network, and to communicate with them. For example, communication interface 213 can receive data (via the communication system) and forward it to processor 210 and/or receive data from processor 210 and send it (via the communication system). Examples of a communication system are a local area network (LAN), wide area network (WAN), wireless network (for example, according to the IEEE 802.11 standard, the Bluetooth (LE) standard and/or the NFC standard), wired network, mobile network, telephone network and/or the Internet. For example, the communication interface 213 can be used to communicate with the Internet and/or other devices. In case of the entities according to FIG. 1, the respective communication interface 213 can be used for example to communicate with the respective other entities or the Internet.

One or more air humidity information (cf. step 301 according to FIG. 3), and/or one or more ambient humidity information (cf. step 302 according to FIG. 3), and/or one or more drying information (cf. step 303 according to FIG. 3) can be received (e.g., received) via such a communication interface 213 or output to a further device. Several of these pieces of information are received (e.g., received) or output if the procedure is carried out and/or controlled several times (e.g., repeated), i.e., more than once, after the first aspect of the invention.

Furthermore, processor 210 can control at least one optional input/output device 213. For example, input/output device 213 is a keyboard, mouse, display unit, microphone, touch-sensitive display unit, speaker, reader, drive and/or camera. For example, input/output device 213 can receive input from a user and forward it to processor 210 and/or receive and output information for the user from processor 210.

Finally, the device 20 according to FIG. 2 can include further components 215, 216.

Air humidity sensor(s) 215 can, for example, record one or more air humidity information (see step 301 and step 302 according to FIG. 3).

Sensor(s) 216 are for example temperature sensors to collect at least one temperature information and/or one or more air pressure sensors, just to name a few non-limiting examples.

The execution examples listed below should also be understood as disclosed:

Example A—Domestic appliance designed as (electric) clothes dryer (short: Dryer): The following frame parameters have been pre-defined, with which a washing of objects was performed:

Nominal load: 7 kg

Program: Cotton 40° C.

Program runtime: approx. 180 min.

Loading: according to DIN EN 60456, approx. 5 kg/approx. 70% of nominal load

Spin speed: 800-1400 rpm (revolutions per minute)

The items washed with the above frame parameters were then placed in the tumble dryer (e.g., domestic appliance 300 according to FIG. 1), where a drying process with the following frame parameters was started:

Nominal load: 7 kg

Program: Cotton extra dry, spin speed normal

Loading: according to DIN EN 60456, approx. 5 kg/approx. 70% of nominal load

The washing machine was loaded with the laundry according to DIN EN 60456, in modification of the standard not layered, but simply tamped. Washed with a detergent (added in the main wash cycle via the dosing drawer). The laundry was weighed dry before the washing process. At the end of the washing cycle, the laundry was weighed spin-dry and the residual moisture calculated. The spin-damp laundry was placed in the cold dryer and the program started.

The following experiments can be used to demonstrate that the process in question can measure, monitor and, if necessary, control the drying of laundry, for example. Three different residual moisture levels were set for this purpose.

| Washing machines | Example 1 | Example 2 | Example 3 |
|---|---|---|---|
| Cleaning agents | 73 ml | 73 ml | 73 ml |
| Loading laundry | 4988.2 g | 5058.7 g | 5058.6 g |
| Moist weight | 7521.6 g | 7161.5 g | 6877.5 g |
| Residual humidity | 2533.4 g | 2102.8 g | 1818.9 g |
| Residual humidity | 50.8% | 41.6% | 36.0% |

The spin-damp laundry was then dried in a tumble dryer in extra-dry mode. The extra drying mode allows to display the complete possible drying process. This results in the following measured values:

| Clothes dryer | Example 1 | Example 2 | Example 3 |
|---|---|---|---|
| Dry weight | 4944.6 g | 4910.0 g | 4912.0 g |
| Total running time | 160 min. | 124 min. | 115 min. |
| Energy Consumption | 1.70 kWh | 1.48 kWh | 1.26 kWh |
| Washing temp. T max. | 47° C. | 59° C. | 60° C. |

In addition to the summary process data, an in-process sensor was used to compare the drying processes. This sensor sends live data as recorded humidity information from the dryer every second via Bluetooth connection. Furthermore, running time and temperature were recorded as recorded temperature information. The (air humidity) sensor was located inside the treatment room, e.g., inside a textile (e.g., wrapped by it) and moved freely in the drying container. The air humidity was measured with a capacitive humidity sensor with an accuracy of ±5% in combination with an air pressure sensor.

Figure 4:
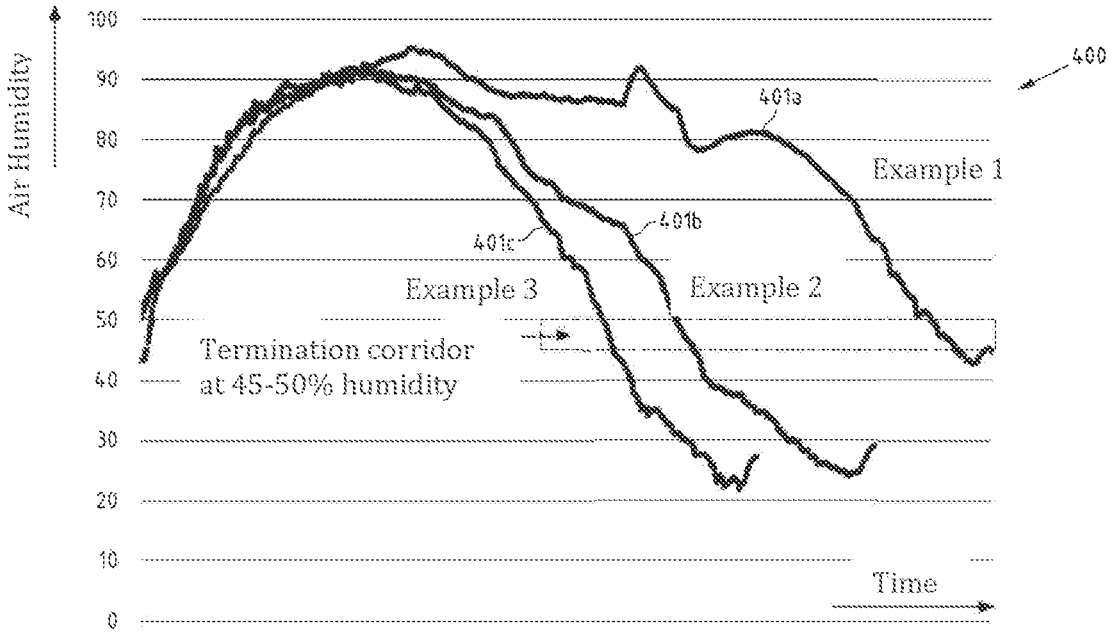
FIG. 4 a first exemplary course of recorded humidity information (see also execution example A).

In FIG. 4, the results of a certain drying information are shown as diagram 400 of the previously recorded humidity information(s) 401*a* to *c* (of the correspondingly described examples 1 to 3) over the complete drying process of the domestic appliance (e.g., domestic appliance 300 according to FIG. 1).

FIG. 4 shows an air humidity/time diagram and illustrates that the processes show completely different process sequences depending on the residual humidity set according to the program. From the available data it is advisable to use at least the (relative) humidity or air humidity as command variable for the process.

For living spaces, a relative humidity of 40-50% is recommended as pleasant. Examples 2 and 3 show that the objects to be dried (e.g., laundry) are overdried after passing through the process, i.e., more water has been expelled than was previously present in the dry laundry. Consequently, surprisingly, it turned out that it is advisable to stop the drying process when entering the corridor of 50% relative humidity and remove the objects or laundry. The laundry is perceived by the consumer as normally dried. This significantly shortens the overall process times compared to the above-mentioned example for consumption:

| Clothes dryer | Example 1 | Example 2 | Example 3 |
|---|---|---|---|
| Dry weight | 4944.6 g | 4910.0 g | 4912.0 g |
| Runtime | 160 min. | 124 min. | 115 min. |
| Running time when 50% relative humidity is reached | 148 min. | 100 min. | 86 min. |

It is once again clear that the reduction of the time required for a drying run (examples 1./.3) is significant and can be considered a direct benefit to the user.

From the user's point of view, it can now be interesting to receive status information about the running process at any possible time, e.g., the remaining runtime. With the help of an (air humidity) sensor, which is either fixed or freely movable in the moist air flow (within the treatment room) of the dryer, a prognosis of the remaining running time and a description of the process is possible via the air humidity parameter. Depending on the residual moisture of the objects (e.g., laundry, such as textiles), characteristic curves result, which can best be described by subsections of polynomial functions. The drying process of the performed treatment can be translated with an acceptable accuracy ($R^2$) e.g., into a third-degree polynomial that can be described by the general formula:

$$Ax^3+Bx^2+Cx+D=y$$

With y as target value in the present case (e.g., relative humidity), the quantity x, in the present case the time, can be determined by employing known solution methods for polynomial functions. However, the accumulated data can also be used to predict the course of a curve and the total running time. In this way, the user receives time information for the ongoing process based on continuous real data calculations and can plan his domestic activities.

Figure 5:
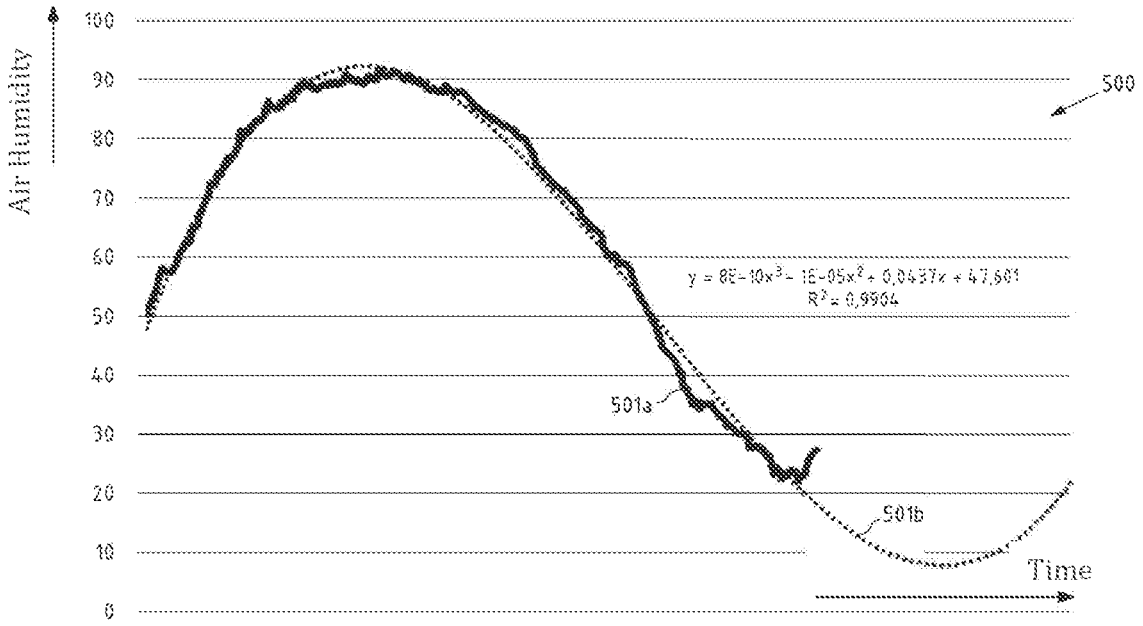
FIG. 5 a second exemplary course of recorded humidity information (see also execution example A).

The proposed procedure is illustrated by example 3 in the following FIG. 5. FIG. 5 shows another humidity/time diagram. In FIG. 5, the results of a specific drying information are shown as Diagram 500 of the previously recorded air humidity information(s) 501*a* (corresponds to the course 401*c* of FIG. 4) over the complete drying process. Furthermore, FIG. 5 shows a polynomial function of the third degree 501b, which idealizes the course of the recorded humidity information 501*a* over the complete drying process.

An advantage of a continuous calculation is not only the more accurate prediction but also the adaptability to unforeseen events, such as a process interruption or the addition of further textiles.

The solution according to all aspects of the present disclosure thus enables, among other things, a laundry treatment process for shortening the drying times of laundry in the electric tumble dryer/wash dryer. Furthermore, according to all aspects of the present invention, the solution as contemplated herein allows, inter alia, a method of controlling and/or regulating a drying process of laundry in an electric laundry dryer/wash dryer by using at least one air humidity sensor in the moist air stream of the laundry. Furthermore, the solution according to all aspects of the present disclosure allows, among other things, a method for wireless transmission of process states and signals to a receiving unit located outside the domestic appliance (e.g., mobile unit 400 according to FIG. 1) by employing a sensor unit freely movable or fixed in the container and comprising at least one air humidity sensor.

Example B—Domestic appliance designed as (domestic) dishwasher (e.g., domestic appliance 300 according to FIG. 1):

Loading: 100% (14 standard place setting)

Program: Automatic

Dirt: 200 ml milk 3.5%+1 teaspoon ground coffee

Cleaner: 1 tab cleaning agent

The fully loaded dishwasher was started in the automatic program by adding 200 ml milk and 1 teaspoon coffee powder. The addition of food is used to simulate a soiled load. The dishwasher reacts by evaluating the signal of its built-in turbidity sensor by adjusting the time and temperature of the wash program. In the dishwasher there is a sensor module in a waterproof housing fixed in the lower rinse basket in the right front area. However, the sensors may also be installed, for example, in the housing in the electronics of an automatic dosing device, e.g., designed as a device according to the second aspect of the present invention, or they may be attached (e.g., movable) to the inner housing of the dishwasher. The measurement of the relative air humidity within a treatment room of a dishwasher, which is represented by one or more humidity data collected in this way, is carried out by employing two stainless steel electrodes, to which a DC voltage is applied, by evaluating the resistance of the electrolytes. The temperature represented by a temperature information is recorded (e.g., measured) via an NTC element. Subsequently, for example, a drying information can be determined at least partially based on the one or more air humidity information and optionally on the recorded temperature information.

Figure 6:
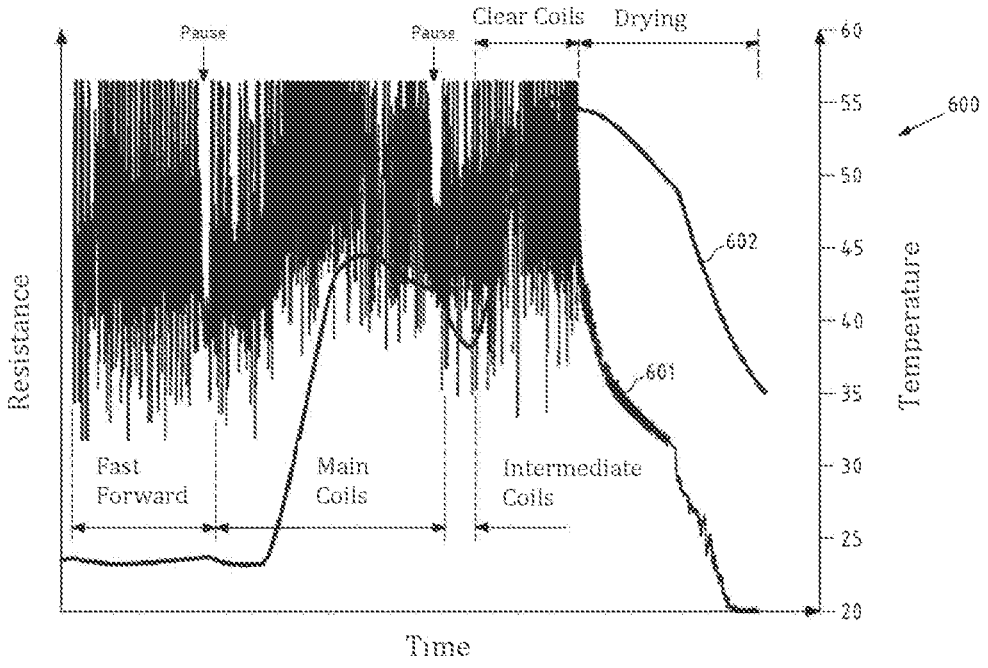
FIG. 6 a third exemplary course of recorded humidity information and recorded temperature information (see also execution example B)

In FIG. 6, the results of a specific drying information are shown as diagram 600 of the previously recorded humidity information 601 and the recorded temperature information 602 over the complete rinse cycle.

Besides the main rinse cycle, where the actual cleaning of the dishes takes place, the drying process is at least the second longest process step. The drying process often takes 30 to 60 minutes. It can therefore be advantageous for the user to shorten this step, especially if he needs the dishes again quickly. Therefore, it is valuable for the user to get a current status, e.g., represented by the drying information during the rinsing or drying process. It is then up to the user, for example, to interrupt the drying process by opening the domestic appliance, in this case the dishwasher, and/or pressing the "Off" button. The beginning of the drying process is exemplified by a sudden drop of the resistance value of an air humidity sensor detecting it and much smaller deflections of the detected air humidity information (e.g., measured values or a detected signal). At this moment, the dishwasher stops the water circulation and no more conductive liquid is led past the (air humidity) sensor. Only a water film or a water cushion (depending on the construction) forms between the two electrodes of the (air humidity) sensor, which now provides only a slightly alternating signal.

It goes without saying that the evaluation of the resistance measurement represented by the one or more air humidity information can also be carried out over the entire rinse cycle (cleaning program comprising a drying process). In particular, the pauses between the individual process sections of the rinse cycle can be used to identify the respective process steps.

Figure 7:
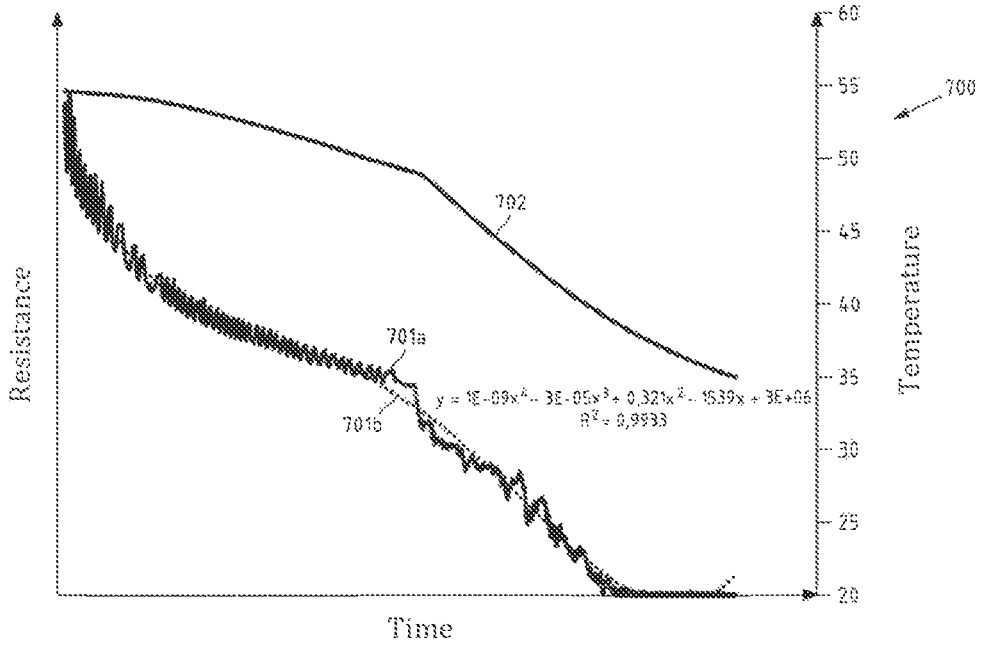
FIG. 7 a fourth exemplary course of recorded humidity information and recorded temperature information (see also execution example B).

In FIG. 7, the drying process is shown as an extract of the representation in the previous FIG. 6. In FIG. 7, the results of a certain drying information are thus shown as diagram 700 of the previously recorded humidity information 701*a* and the recorded temperature information 702 over the complete rinse cycle. The course 701*b* shows a certain polynomial function of fourth degree, which represents the course of the recorded air humidity information(s) 701*a*, and which can be used, for example, to determine the drying information, which in represents a predicted end of the performed drying process.

It is now possible to describe the gradual evaporation of the water film between the two electrodes of the (air humidity) sensor as a continuous drying process. That can happen once by the pure seizing of the air humidity information (e.g., measuring the resistance value over the time by employing an air humidity sensor) and alternatively or additionally by the computation (differentiation) of the temporal change of the value (the relative air humidity). The kink in the curves 701*a*, 701*b* and 702 shown in FIG. 7 is the automatic opening of the door, a feature that includes the dishwasher used.

The user can be provided with a current status represented by the drying information during the ongoing process and can better plan his domestic activities. An important information is e.g., the end of the whole process, especially if the user is not nearby. For this purpose, the drying information can be sent wirelessly to the user, e.g., as a push message on an app, from a (air humidity) sensor located in the machine, which is included in an (automatic) dosing device. The drying information can also be part of a monitoring and control concept of a self-sufficient automatic dosing unit. For this purpose, a program receives one or more drying information at regular intervals, which is output by the domestic appliance 300 according to FIG. 1, e.g., designed as a dishwasher, so that this information can be output to the user in text or graphic form by a mobile device 400 according to FIG. 1. The drying information can also be translated into time information according to the scheme "20 minutes to go". In addition, the user is also enabled to decide based on the drying information to terminate the process prematurely and thus save time and/or to have the dishes available again earlier.

On the other hand, the process can also be converted into an algorithm, especially if the drying information is to be converted into predictive time information. In the present case, a fourth-degree polynomial function describes the process of evaporation of water and thus the drying of the dishes. If the course of the drying curve can be described with a corresponding (polynomial) function, it is possible to predict (e.g., predict) the physically optimal end time of the drying process. It is also preferred that the calculation of the end time is learned. This means, for example, that an algorithm describing the drying process can be adapted and optimized by continuously taking over new and/or historical information (e.g. (historical) air humidity information, (historical) ambient humidity information, as well as (historical) drying information, just to name a few non-limiting examples), e.g., within the execution of an artificial neural network.

In both applications described according to design example A and design example B laundry dryer/washing dryer and dishwasher, the recorded air humidity information, environment information and at least one specific drying information (e.g. based on measured values) can also be used in conjunction with an API to actively control the drying process in the domestic appliance and to end drying processes or cleaning programs including drying processes under measurement value control (i.e. based on the specific drying information). For the user, this has the advantage that he does not have the feeling that he is ending a process (e.g., cleaning program comprising a drying process or a drying process) prematurely, which in his opinion might be unfavorable or might lead to a malfunction. In the case of dishwashers, this type of control and/or regulation can even be especially useful, because condensate sometimes still must be pumped out of the treatment room at the end of the drying process. In the case of a simple abort, this pumping out would no longer be executed, for example. Via the API, the (air humidity) sensor or dosing device can comprehensively take over this sensor also the complete control of the domestic appliance and thus create a temporally and energetically optimized and seamless user experience for the user.

The process according to all aspects of the present disclosure can, for example, be carried out continuously so that, for example, one or more pieces of air humidity information are continuously recorded by employing at least one air humidity sensor and/or the at least one air pressure sensor, and further, for example, ambient humidity information is recorded or obtained at least once (alternatively: more than once, e.g. successively), and subsequently (e.g. successively) the drying information is determined, for example, based on the most current air humidity information and the most current ambient humidity information. For example, one or more of the following aspects apply to all aspects of the invention:

All data and information can be stored locally and remotely.

All data or information can be subjected to additional data analysis.

All data or information can be edited with a machine learning tool.

Conclusions about user behavior can be drawn from the data or information.

User profiles can be created from the data or information; and

From the results of data analysis and/or machine learning, which can, for example, determine the drying information, algorithms (instructions for action) for the operation of a self-sufficient dosing unit and/or the air-carrying domestic appliance can be derived.

The examples of execution of the present disclosure described in this specification and the optional features and properties mentioned in each case shall also be understood as disclosed in all combinations. In particular, the description of a feature included in an execution example—unless explicitly stated otherwise—should not be understood in the present case to mean that the feature is indispensable or essential for the function of the execution example. The sequence of the process steps described in this specification in the individual flowcharts is not mandatory, alternative sequences of process steps are conceivable. The process steps can be implemented in different ways, e.g., an implementation in software (by program instructions), hardware or a combination of to implement the process steps is conceivable.

Terms used in the claims such as "comprise", "have", "include", "contain" and the like do not exclude further elements or steps. The expression "at least partially" covers both the "partially" case and the "fully" case. The phrase "and/or" should be understood to mean that both the alternative and the combination should be disclosed, i.e. "A and/or B" means "(A) or (B) or (A and B)". The use of the indefinite article does not exclude a plural. A single device can perform the functions of several units or devices mentioned in the patent claims. Reference marks indicated in the claims are not to be regarded as limitations of the features and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A process, comprising:

detecting, by one or more dosing devices having at least one air humidity sensor, air humidity information indicative of a relative air humidity within a treatment room of an air-conducting household appliance, wherein the dosing device is arranged to deposit a substance in the treatment room, wherein the air humidity information represents a curve progression of the relative air humidity within the treatment room over time; and determining, by at least one processor at the dosing device, drying information indicative of a time of an end of a drying process performed by the air-conducting household appliance, wherein the time of the end is a first time before a second time of an end of a drying time scheduled by the air-conducting household appliance, wherein the drying information is determined based on the air humidity information; and transmitting, from the dosing device, the drying information including the first time and transmitting to a remote device remote from the air-conducting household appliance.

2. A process according to claim 1, further comprising: describing a course of the curve by employing a mathematical function using the one or more dosing devices that predicts the humidity inside the treatment room of the air-conducting household appliance at any time during the process.

3. A process according to claim 1, further comprising: collecting or obtaining ambient humidity information indicative of a humidity level that exists or is expected to exist in ambient air of the household appliance using the one or more dosing devices, wherein the drying information is further determined using the one or more dosing devices based on the ambient humidity information.

4. A process according to claim 1, wherein the drying information is further indicative of a humidity value of one or more objects within the treatment room, said one or more objects being subject to drying by employing of the drying process.

5. A process according to claim 1, wherein the curve progression is described by employing an n-graded polynomial function using the one or more dosing devices, and wherein the determination of the drying information is further based on the polynomial function using the one or more dosing devices.

6. A process according to claim 5, wherein the polynomial function is determined using the one or more dosing devices based on the curve of the relative humidity within the treatment room over time.

7. A process according to claim 5, wherein at least two relative humidity values are represented or comprised by the humidity information, wherein the at least two relative humidity values are further each linked to a different respective detection time such that the dosing device maps each relative humidity value over a different respective detection time using the polynomial function.

8. A process according to claim 1, further comprising: output or initiation of the output of the drying information using the one or more dosing devices.

9. A process according to claim 1, further comprising: control and/or regulation of the air-conducting household appliance at least partially based on the drying information using the one or more dosing devices.

10. The process according to claim 9, wherein the control and/or regulation of the air-conducting household appliance using the one or more dosing devices causes a drying process performed by the air-conducting household appliance to be terminated as soon as the objects to be dried within the treatment room have the relative humidity value represented by ambient humidity information.

11. A process according to claim 1, wherein the drying information is further determined by using historical humidity information and/or historical drying information from one or more drying processes previously performed with the air-conducting household appliance.

12. A process according to claim 8, whereby the output or initiation of the output of the drying information is repeated using the one or more dosing devices so that a user of the air-conducting household appliance is informed about the current status of a program or drying process performed by the household appliance.

13. A process according to claim 1, wherein at least the acquiring the air humidity information and determining the drying information are repeatedly performed using the one or more dosing devices.

14. A process according to claim 1, wherein the at least one air humidity sensor is fixed within the treatment room in moist air flow from the air-conducting household appliance.

15. A process according to claim 1, wherein the air-conducting household appliance is a tumble dryer, washer-dryer, or dishwasher.

16. The process of claim 1, comprising:

providing, at the remote device, an indication of the first time of the end of the drying process to inform a user of the remote device by using the drying information; and providing a prompt on the remote device for a user to select to deactivate the drying process at the first time.

17. The process of claim 16, comprising:

receiving the selection to deactivate at the dosing device; and transmitting a signal from the dosing device to the air-conducting household appliance to deactivate the drying process.

18. The process of claim 1, wherein the dosing device and humidity sensor are freely movable within the treatment room in moist air flow from the air-conducting household appliance.

19. An apparatus, comprising:

one or more dosing devices inside a treatment room of an air-conducting household appliance, wherein the dosing device comprises:

at least one air humidity sensor arranged to detect air humidity information indicative of a relative air humidity within the treatment room, wherein the dosing device is arranged to deposit a substance in the treatment room, and wherein the air humidity information represents a curve progression of the relative air humidity within the treatment room over time, and at least one processor arranged to operate by determining drying information indicative of a time of an end of a drying process performed by the air-conducting household appliance, wherein the time of the end is a first time before a second time of an end of a drying time scheduled by the air-conducting household appliance, and wherein the drying information is determined based on the air humidity information, and wherein the at least one processor being arranged to operate by transmitting, from the dosing device, the drying information including the first time and transmitting to a remote device remote from the air-conducting household appliance.

20. A system, comprising:

an air-conducting household appliance having a treatment room arranged to receive objects to dry and a first controller to activate a drying process for a predetermined duration and deactivate the drying process at an end of the duration;

a dosing device within the treatment room and arranged to deposit a substance within the treatment room, wherein the dosing device comprises at least one humidity sensor and at least one processor arranged to operate by generating drying information including a first time of an end of the drying process that is earlier than a second time of the end of the duration; and a remote device remote from the air-conducting household appliance and having a third controller arranged to receive a signal from the dosing device wherein the signal has the first time, provide the first time to a user of the remote device, prompt the user to select whether to deactivate the drying process at the first time; and transmit a deactivation signal to the dosing device if the user selects to deactivate the drying process at the first time.

* * * * *